US009850110B2

(12) United States Patent
Cox et al.

(10) Patent No.: US 9,850,110 B2
(45) Date of Patent: Dec. 26, 2017

(54) APPARATUS AND METHOD FOR A SINGLE WALL MOUNTING SYSTEM FOR A CRANE

(71) Applicant: Precision Surveillance Corporation, East Chicago (IN)

(72) Inventors: Christopher Cox, Valparaiso, IN (US); David Maldonado, Homewood, IL (US); Andrew Makinson, Crown Point, IN (US)

(73) Assignee: Precision Surveillance Company, East Chicago, IL (US)

( * ) Notice: Subject to any disclaimer, the term of this patent is extended or adjusted under 35 U.S.C. 154(b) by 172 days.

(21) Appl. No.: 14/838,853

(22) Filed: Aug. 28, 2015

(65) Prior Publication Data

US 2016/0289048 A1 Oct. 6, 2016

(51) Int. Cl.

| | |
|---|---|
| ***B66C 23/20*** | (2006.01) |
| ***B66C 23/78*** | (2006.01) |
| *E02D 7/16* | (2006.01) |

(52) U.S. Cl.

CPC ..... *B66C 23/208* (2013.01); *B66C 23/20* (2013.01); *B66C 23/202* (2013.01); *B66C 23/78* (2013.01); *E02D 7/16* (2013.01)

(58) Field of Classification Search

CPC ..... B66C 23/202; B66C 23/20; B66C 23/78; B66C 23/208; E02D 7/16

USPC ..... 212/179; 182/60, 59, 62

See application file for complete search history.

(56) References Cited

U.S. PATENT DOCUMENTS

| | | | | | |
|---|---|---|---|---|---|
| 1,247,706 | A * | 11/1917 | Moran | B66C 23/20 | 182/145 |
| 2,696,917 | A * | 12/1954 | Kershaw | E01B 29/00 | 105/162 |
| 3,279,195 | A * | 10/1966 | Taylor | E02D 7/20 | 173/33 |
| 4,709,764 | A * | 12/1987 | Gibbons | E02D 7/16 | 173/45 |
| 5,265,742 | A * | 11/1993 | Stenger | B66C 23/205 | 182/60 |
| 6,135,300 | A * | 10/2000 | Fox | B66C 23/208 | 182/60 |
| 7,044,313 | B2 * | 5/2006 | Haliburda | B66C 23/208 | 182/60 |
| 7,523,835 | B2 * | 4/2009 | Andersson | B66C 23/90 | 212/286 |
| 7,537,088 | B2 * | 5/2009 | Spitsbergen | B66C 23/208 | 187/240 |
| 8,465,071 | B2 * | 6/2013 | Risi | B66C 1/28 | 294/110.2 |
| 8,684,136 | B2 * | 4/2014 | Chilton | A62B 1/06 | 182/3 |
| 9,601,036 | B2 * | 3/2017 | Barnard, IV | G09F 7/20 | |

FOREIGN PATENT DOCUMENTS

| | | | | |
|---|---|---|---|---|
| DE | 3822700 A1 * | 1/1990 | B66C 23/202 | |
| FR | 2700797 A1 * | 7/1994 | B66C 23/202 | |

* cited by examiner

*Primary Examiner* — Eret McNichols
(74) *Attorney, Agent, or Firm* — Adam K. Sacharoff; Much Shelist, P.C.

(57) ABSTRACT

There is shown a mounting system for a crane that utilizes frictional engagement to a wall surface and does not use counterweights or conventional methods to resist crane forces.

15 Claims, 8 Drawing Sheets

APPARATUS AND METHOD FOR A SINGLE WALL MOUNTING SYSTEM FOR A CRANE

CROSS REFERENCE TO RELATED APPLICATIONS

The present invention claims priority to U.S. Provisional Application 62/043,107 filed Aug. 28, 2014.

FIELD OF THE INVENTION

The present invention relates to the mounting of a crane and more particularly to an apparatus and method for a single wall mounting system used for a crane.

BACKGROUND OF THE INVENTION

There are various apparatus, methods, and systems utilized today to mount a crane. Various issues exist with the current methods in that the mounting systems today all require counterweights or conventional attachment methods (e.g. bolts, anchors, inserts), hereafter referred to as "conventional methods", to resist overturning forces imposed by the crane. These conventional methods are typically time consuming and expensive, and prove to be cost-prohibitive and time-prohibitive in many environments. The embodiments disclosed herein includes a base frame which supports and secures the crane by friction and does not rely on conventional methods to resist crane forces. There is thus disclosed various embodiments herein directed to mounting systems for a crane.

SUMMARY OF THE INVENTION

In one embodiment of the present invention there is provided a mounting system that supports and secures a crane by friction, imposed on a supporting wall by a crane-mounted lever arm, between a bearing pad and the supporting surface.

In another embodiment there is provided a single wall mount crane assembly configured to support an articulating boom crane against an existing upstanding wall. The assembly includes: (a) a crane base configured to support an articulating boom crane, the crane base having front and rear lower ends; (b) a pair of stub column assemblies separately secured at the front and rear lower ends of the crane base; (c) a crane mount lower frame assembly secured below the pair of stub column assemblies; (d) a plurality of pairs of downrigger columns, each pair of downrigger columns having upper ends configured to attach to opposing sides of the crane mount lower frame assembly such that lower ends, defined by each pair of downrigger columns, diametrically oppose each other; and (e) a bearing pad secured to each lower end of the downrigger columns, and wherein the bearing pads are configured to frictionally engage opposing outside surfaces of the wall, whereby the loads from an articulating boom crane that is secured to the crane base transmits to the crane mount lower frame assembly that resists the loads by having compressive forces applied to the wall by the bearing pads.

In another embodiment, a plurality of swivel mounts may be secured beneath the crane mount lower frame assembly. The plurality of swivel mounts are configured to engage a top surface of the wall to assist in leveling the assembly.

In yet another embodiment, each stub column assembly may include: (a) an upper stub plate having opposing sides, and being secured to one of the front or rear lower ends of the crane base; (b) column legs extending downwardly from the opposing sides of the upper stub plate; (c) cheek plates extending from inside and outside edges of the column legs, each cheek plate having an aperture, and (d) stub pins positioned through the apertures of the cheek plates and openings defined in the crane mount lower frame assembly to secure the stub column assembly thereto. In another aspect, each stub column assembly may further include a stiffener tube positioned between the cheek plates positioned against the inside edges of the column legs.

In yet another embodiment, the crane mount lower frame assembly may include a pair of lower frame subassemblies and wherein each subassembly secures to a front pair and a rear pair of downrigger columns. Each subassembly may include: (i) forward and rearward beams, with each having a beam side and each being connected to each other by side box plates; (ii) a lower frame splice flange extending from each beam side; and (iii) each side box plate having an opening to receive the stub pins.

In another embodiment, wherein each downrigger column may include: (a) a flange having first side configured to face the wall, a top cap and a bottom cap, the column further having an opening extending downward vertically through the top cap towards the bottom cap; (b) a column splice flange secured to the first side towards the top cap and configured to attach to a portion of the crane mount lower frame assembly; (c) wherein the bearing pad is pivotally secured against the first side for frictional engagement against the outside surface of the wall; (d) a lever arm extending through the top cap towards the bottom cap, the lever arm having a pair of lower arm openings spaced to align separately with a pair of slots defined on the flange, and the lever arm further having an upper arm opening; (e) a pair of pivot pins received through the aligned openings in the pair of lower arm openings and the pair of slots and further aligned to pivotally secure the bearing pad thereto; and (f) a tension rod attached between a pair of opposing lever arms through the upper arm openings defined in said opposing lever arms, wherein the tension rod is configured to apply a grip force at the bearing pad when the tension rod is tightened.

And in yet other embodiments, the first side of the flange that is defined in each downrigger column may further include at least one lug opening to receive a pair of spaced shoe lugs extending from a bearing shoe. The bearing pad being secured to a side of the bearing shoe opposite the spaced shoe lugs, and the pair of spaced shoe lugs further have apertures to receive pivot pins.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 4-A shows an exploded isometric view of the downrigger column and bearing pad assembly;

FIG. 5-A is a section showing the right elevation of the single wall mount crane frame installed on an existing concrete wall; and FIG. 5-B shows a zoomed in view of Section 5-A.

DETAILED DESCRIPTION OF THE DRAWINGS

Figure 1:
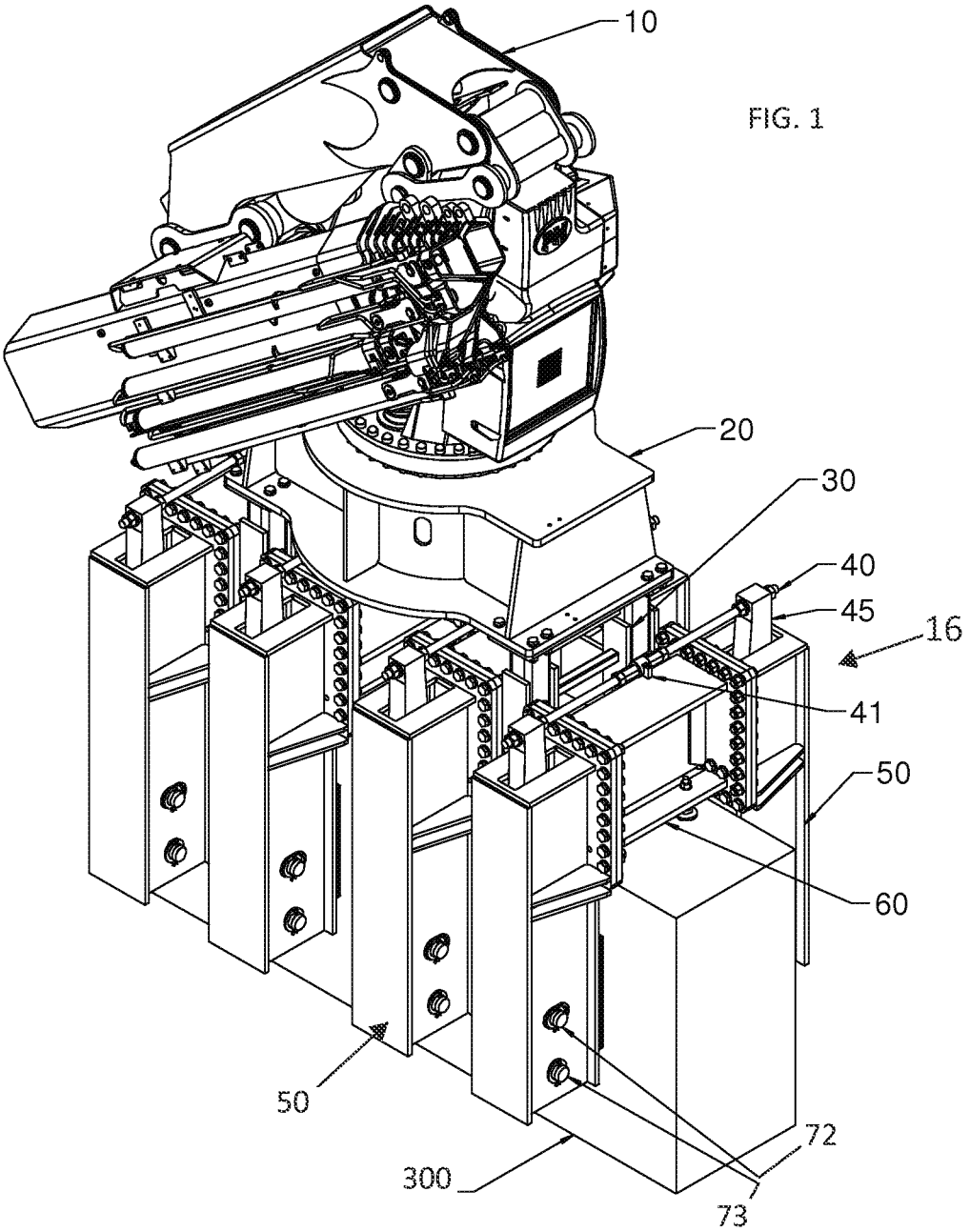
FIG. 1 is an isometric drawing of the single wall mount crane mounting frame with an articulating boom crane installed.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

In general reference to FIGS. 1-5B there is illustrated a Single Wall Mount Crane (SWMC) frame assembly 16 with an articulating boom crane 10 installed in accordance to various embodiments of the invention, in reference thereto, the information provided in the drawings are made part of this specification by reference without limitation to any particular material used or dimensional notations provided therein. In addition, the quantity, type, and dimensions of components shown or labeled in the figures may be changed (either lessen or increased) without effecting the scope of the invention as long as the integrity of the mounting system is maintained. Lastly, the reference to front/rear or sides can be interchangeable and are only used for purposes of reference to illustrate proper alignment.

Figure 3:
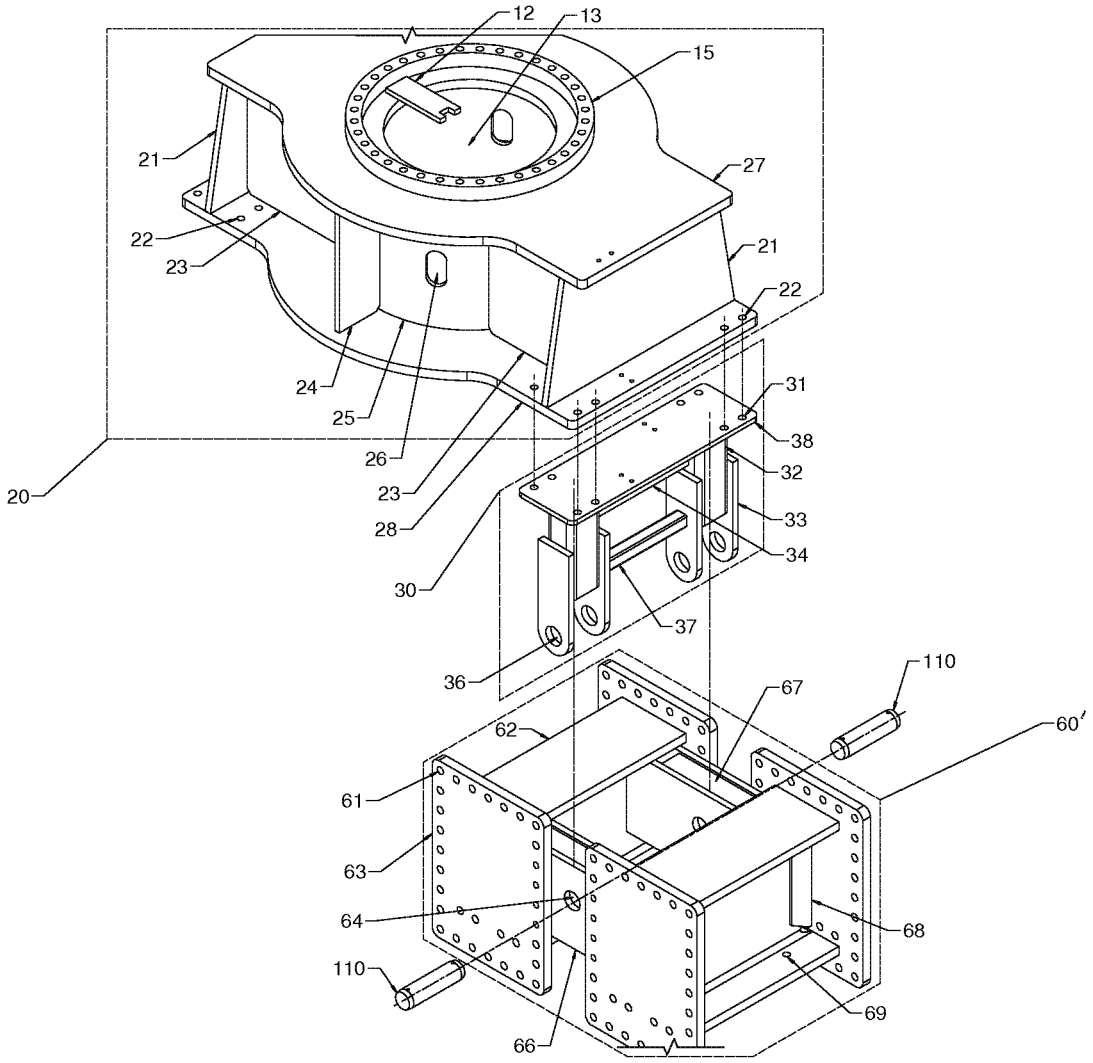
FIG. 3 is an exploded isometric view detailing the crane base connecting to the stub column assembly and the column assembly to the lower frame.
Figure 4:
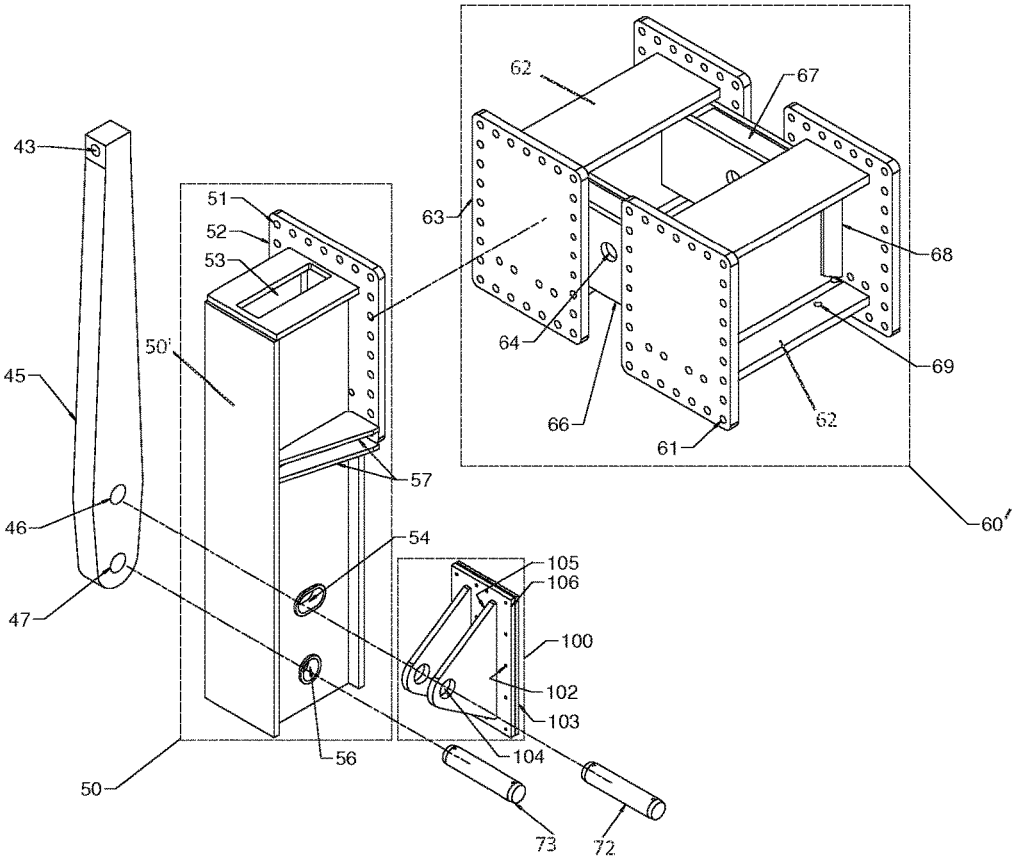
FIG. 4 shows an exploded isometric view detailing the lower frames connecting to the downrigger columns.
Figure 4A:
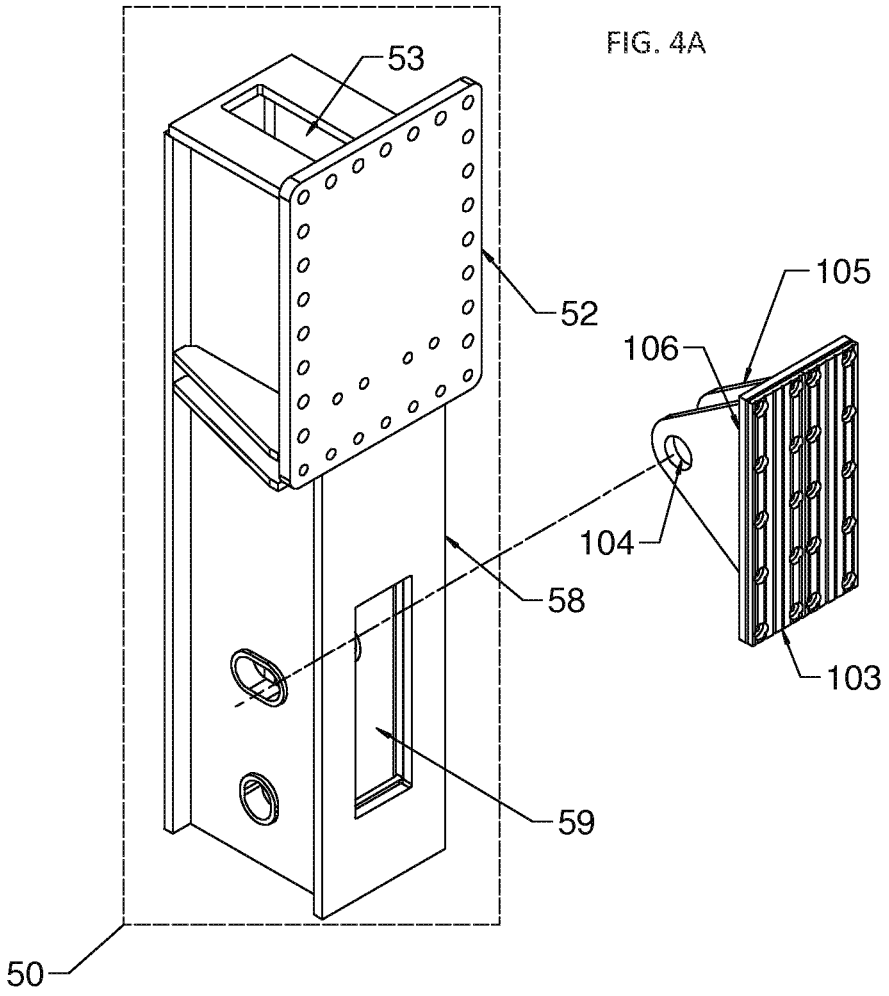
Figure 5:
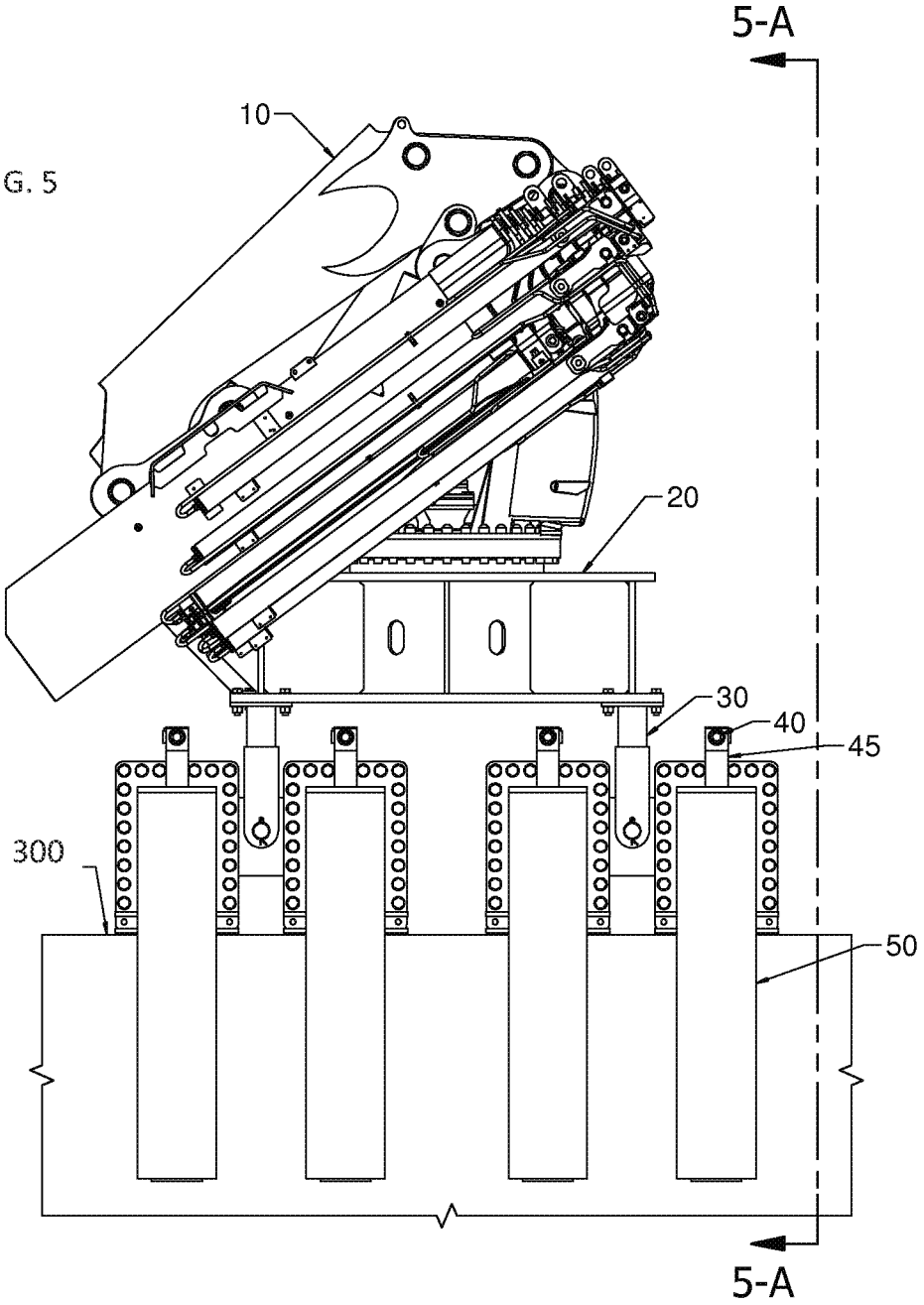
FIG. 5 shows an elevation view of the single wall mount crane frame installed on an existing concrete wall.
Figure 5A:
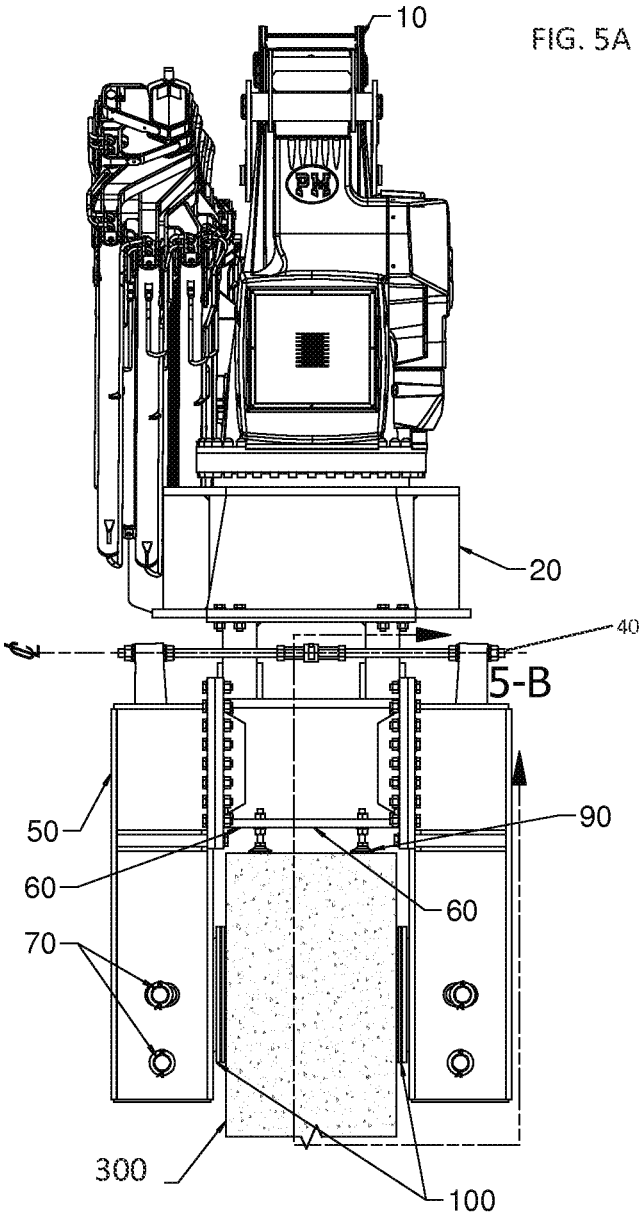
Figure 5B:
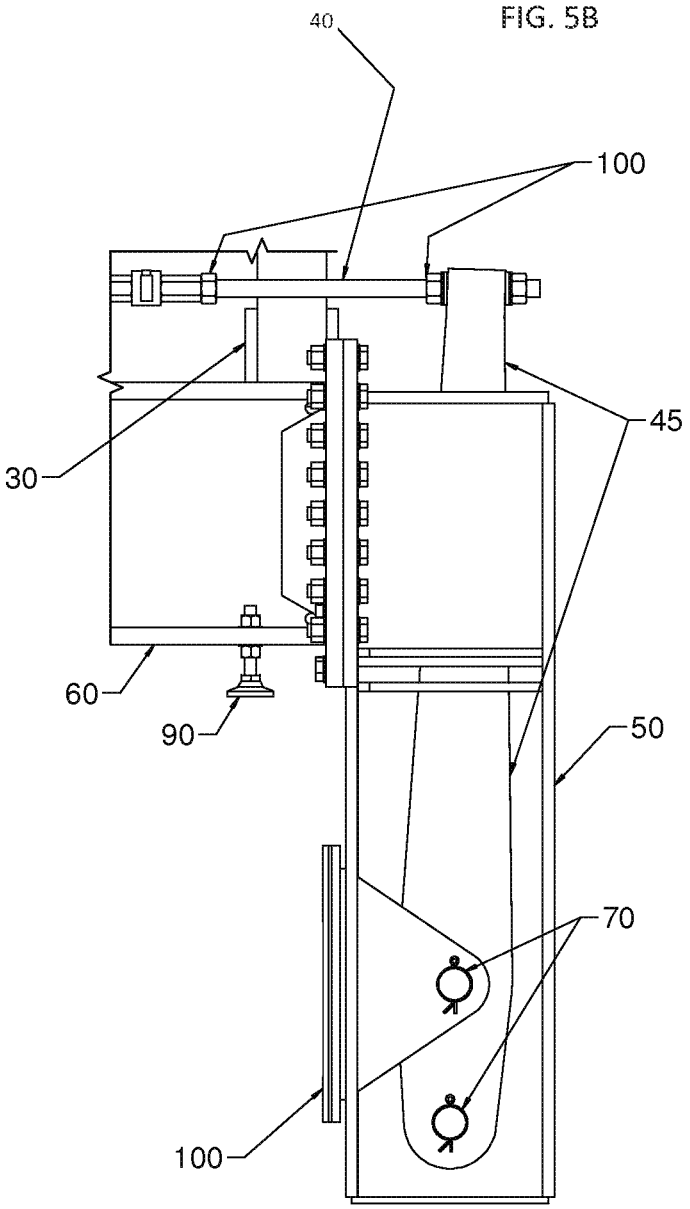

The SWMC frame assembly 16 provides a gripping force on an existing wall 300 which resists the overturning forces imposed on the crane 10. The crane base 20 supports the crane 10 and transmits the loads from the crane 10 to the stub column assembly 30, which then transmit the loads to the lower frames 60 through pins 110 (FIG. 3). The lower frames 60 are mounted to the downrigger columns 50, the bending of which provides the resistance to compressive forces which are applied to the wall by the bearing pads 100.

Figure 2:
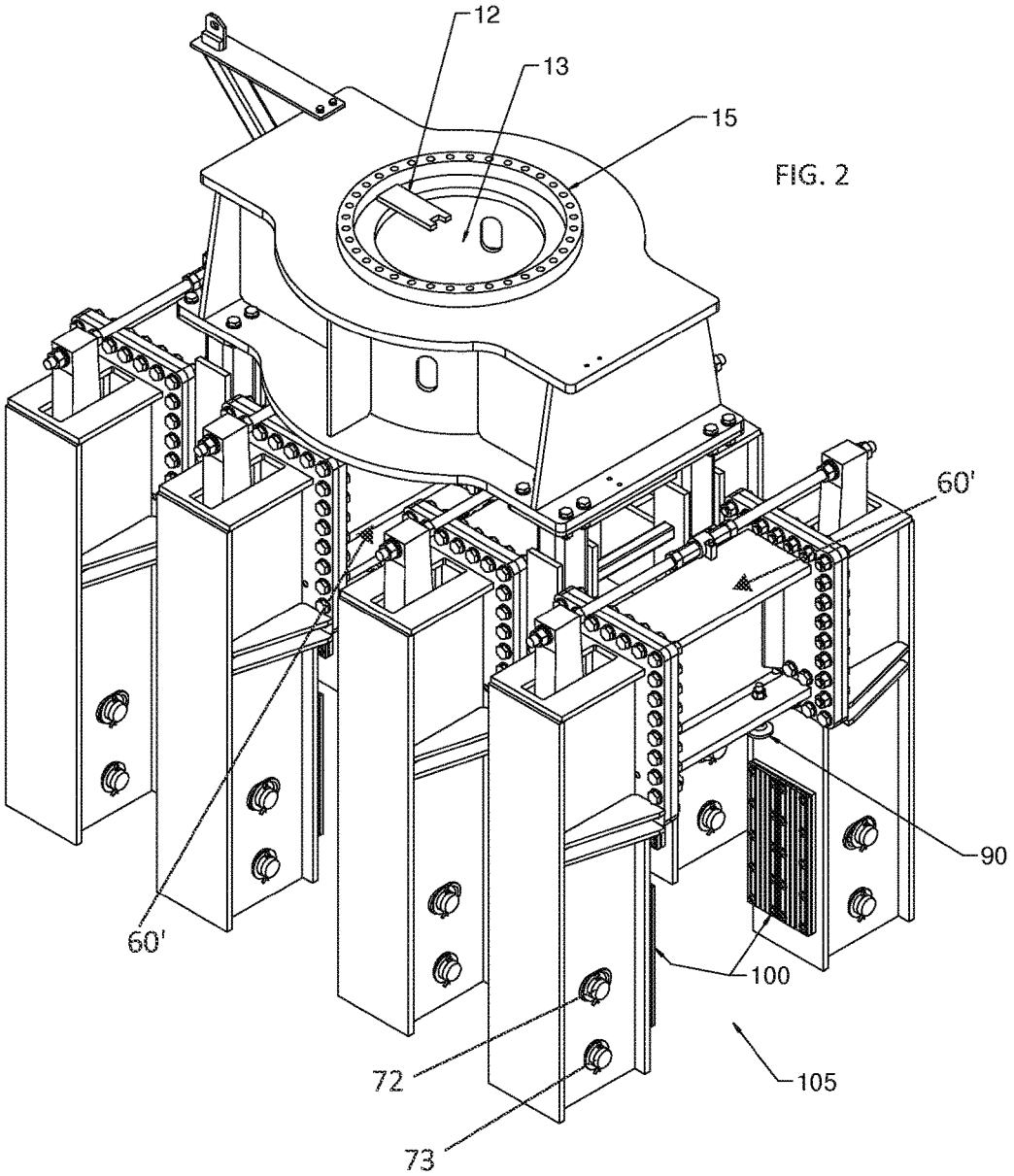
FIG. 2 is an isometric drawing of the single wall mount crane frame without the crane shown on the crane base.

Installation of the SWMC frame assembly 16 involves placing the assembly over a section of the wall 300, which would occupy a space 105, seating the assembly 16 securely against the wall 300 while maintaining levelness with swivel mounts 90. Upon properly locating the SWMC frame assembly 16, tension rods 40 are tightened causing a force to be applied to a lever arm 45 which applies force to an upper pin 72, causing a damping force to be transmitted to the wall 300 between pairs of opposing bearing pads 100' (FIG. 2). The bearing pads 100 transmit forces from the crane 10 to the existing wall 300 through the SWMC frame assembly 16 without any need for additional support.

Continuing to refer to FIGS. 1 through 5-8 the mounting system includes the SWMC frame assembly 16 that is mounted to a support surface, such as a wall section 300, that may be pre-existing or constructed for purposes of mounting the SWMC frame assembly 16. The SWMC frame assembly 16 includes an upper crane mount frame 20 that secures the crane 10 to the lower frame assembly 60 by use of a stub column assembly 30. The upper crane mount frame assembly 20 includes a pair of first side plates 21 separately spaced and secured to a pair of second side plates 23, both of which are secured to a top plate 27 and a base plate 28. The top plate 27 includes a plurality of apertures on a crane slewing mount ring that receives and secures the crane 10. As illustrated a crane rotation stop key 12 is shown and which interfaces with the crane base to prevent crane rotation and a crane hydraulics cavity 13 used to pass through the hydraulics theretrough. The upper crane mount frame assembly 20 further includes a pipe 25 that forms a portion of the wall and includes a slot 26, which permits hydraulic lines (not shown) to be accessed. Ribs 24 are also positioned between the top plate 27 and the base plate 28 extending from the pipe 25 to provide support against the weight of the crane 10, when the crane 10 attached to the top plate 27. The base plate 28 further includes fastening openings 22 about first and second sides thereof that secure the upper crane mount frame assembly 20 to first and second lower frame assemblies 50 by first and second stub column assemblies 30 (as explained in greater detail below). It is important to note that the number of lower frame assemblies and sub column assemblies could change without changing the scope of the invention.

Each stub column assembly 30 includes an upper stub plate 38 with fastening openings 31 to correspond to the fastening openings 22 on the base plate 28. Extending separately from each end of the upper stub plate 38 are downwardly extending column legs 32 which have on either side thereof downwardly extending cheek plates 33. As such, as illustrated, there are two pairs of cheek plates 33 with the inside cheek plates being separated by a stiffener tube 37 to keep them aligned. Another stiffener plate 34 is secured below the upper stub plate 38 to further ensure the column legs 32 are aligned. Each cheek plate 33 includes an opening 36.

The crane mount lower frame assembly 60 may include one or more lower frames subassemblies 60'. Typically each lower frame subassembly 60' corresponds to two pair of legs. For example, in FIG. 1 two pair of downrigger columns 50 extend downwardly from each crane lower frame subassembly 60', one pair of downrigger columns 50 from a front portion of the lower frame subassembly 60' and one pair from the rear portion of the lower frame subassembly 60'. Each pair of downrigger columns 50 secure to the lower frame assembly 60, from which the two lower frame subassemblies 60' together define the crane mount lower frame assembly 60.

Each lower frame subassembly 60' includes forward and rearward beams 62 with side box plates 66 and 67 positioned between the forward and rearward beams 62. Pairs of lower frame splice flanges 63 are secured on either side of the forward and rearward beams 62. In addition, the side box plates 66 and 67 include openings 64 to secure and align to openings 36 in the stub column assembly 30 by use of a pin 110.

As noted, each lower frame subassembly 60' includes lower frame splice flanges 63 on either side of the beams 62. This allows for downrigger columns 50 to be secured on either side of the lower frame subassembly 60'. As each downrigger column 50 includes a downrigger column splice flange 52 that can be secured to a lower frame splice flange 63 through openings 51 and 61. Stiffener plates 57 are positioned against the downrigger column splice flange 52 and the rear portion 50' of the downrigger column 50 to prevent the flange 52 from bending.

Each downrigger column 50 includes a vertical flange 58 with at least one face that includes one or more openings 59 to receive a pair of spaced shoe lugs 105 extending from a bearing shoe base 106 defined on a wall bearing shoe 100. When assembled a pair of bearing shoes 100 with bearing pads 103 face each other on opposing downriggers columns 50. Each downrigger column 50 further includes an opening 53 extending downward vertically through the top cap towards the bottom cap. The opening 53 is sized sufficiently to receive a lever arm 45. Each lever arm 45 includes a pair of openings 46 & 47 towards the bottom end thereof and spaced to align with upper downrigger column slot 54 (orientated horizontally) and a lower downrigger column slot 56 (orientated vertically) positioned through the downrigger column 50. The upper pivot pin 72 may be inserted through the upper downrigger column slot 54 such that it secures through the lever arm upper opening 46 and openings 104 in the bearing shoe lugs 105. And a lower pivot pin 73 may be inserted through the lower downrigger column slot 56 and the lower lever arm opening 47 in order to secure the lower end of the lever arm 45 to the downrigger column 50.

Each grip lever arm 45 further includes an opening 43 along its upper section. When assembled in the downrigger columns 50, a pair of grip lever arms 45 are positioned and align to each other. A threaded tension rod 40 is then secured between a pair of opposing grip lever arms 45 through the upper sections 43 thereof. Tightening of the tension rod 40 applies grip force at the bearing shoe grip surface 103. An inline threaded load sensor 41 may be secured to the threaded tension rod 40.

It should be well known that the positions and number of the openings described herein and shown in the attached may be changed without changing the scope of the invention. In addition, in some instances, the sub-assembly components discussed herein and shown in the attached may be interchanged with a similar assembly in order to accommodate a different size, type or brand of crane.

As mentioned, a support wall 300 can be positioned for frictionally securing the mounting system thereto. The grip pads 103 from the bearing pad assembly 100 are positioned against the surface of the support wall 300 and can be tightened against the wall by adjusting the tension in the threaded tension rod 40 on the lever arms 45.

The crane 10 is secured to the support wall 300 by frictional forces alone and does not rely on counterweights or conventional methods to resist crane forces.

All parts of the assembly may be comprised of steel members welded or bolted together utilizing conventional pin, welding, and bolting techniques common to structural steel construction.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A single wall mount crane assembly configured to support an articulating boom crane against an existing upstanding wall, the wall having opposing outside surfaces, the assembly comprising:

a crane base configured to support an articulating boom crane, the crane base having front and rear lower ends;

a pair of stub column assemblies separately secured at the front and rear lower ends of the crane base, and wherein each stub column assembly includes: an upper stub plate having opposing sides, and being secured to one of the front or rear lower ends of the crane base, column legs extending downwardly from the opposing sides of the upper stub plate, cheek plates extending from inside and outside edges of the column legs, each cheek plate having an aperture, and stub pins positioned through the apertures of the cheek plates and openings defined in the crane mount lower frame assembly to secure the stub column assembly thereto;

a crane mount lower frame assembly secured below the pair of stub column assemblies;

a plurality of pairs of downrigger columns, each pair of downrigger columns having upper ends configured to attach to opposing sides of the crane mount lower frame assembly such that lower ends, defined by each pair of downrigger columns, diametrically oppose each other; and a bearing pad secured to each lower end of the downrigger columns, and wherein the bearing pads are configured to frictionally engage opposing outside surfaces of the wall, whereby the loads from an articulating boom crane that is secured to the crane base transmits to the crane mount lower frame assembly that resists the loads by having compressive forces applied to the wall by the bearing pads.

2. The assembly of claim 1 further comprising a plurality of swivel mounts secured beneath the crane mount lower frame assembly, the plurality of swivel mounts are configured to engage a top surface of the wall to assist in leveling the assembly.

3. The assembly of claim 1, wherein each stub column assembly further includes a stiffener tube positioned between the cheek plates positioned against the inside edges of the column legs.

4. The assembly of claim 1, wherein the crane mount lower frame assembly includes a pair of lower frame subassemblies and wherein each subassembly secures to a front pair and a rear pair of downrigger columns, each subassembly includes:

forward and rearward beams, each having a beam side and each being connected to each other by side box plates, a lower frame splice flange extends from each bean side, and each side box plate having an opening to receive the stub pins.

5. The assembly of claim 4, wherein each downrigger column includes:

a flange having first side configured to face the wall, a top cap and a bottom cap, the column further having an opening extending downward vertically through the top cap towards the bottom cap, a column splice flange secured to the first side towards the top cap and configured to attach to the lower frame splice flange on the lower frame subassembly;

wherein the bearing pad is pivotally secured against the first side for frictional engagement against the outside surface of the wall;

a lever arm extending through the top cap towards the bottom cap, the lever arm having a pair of lower arm openings spaced to align separately with a pair of slots defined on the flange, and the lever arm further having an upper arm opening;

a pair of pivot pin received through the aligned openings in the pair of lower arm openings and the pair of slots and further aligned to pivotally secure the bearing pad thereto; and a tension rod attached between a pair of opposing lever arms through the upper arm openings defined in said opposing lever arms, wherein the tension rod is configured to apply a grip force at the bearing pad when the tension rod is tightened.

6. A single wall mount crane assembly configured to support an articulating boom crane against an existing upstanding wall, the wall having opposing outside surfaces, the assembly comprising:

a crane base configured to support an articulating boom crane, the crane base having front and rear lower ends;

a pair of stub column assemblies separately secured at the front and rear lower ends of the crane base;

a crane mount lower frame assembly secured below the pair of stub column assemblies, and wherein the crane mount lower frame assembly includes a pair of lower frame subassemblies and wherein each subassembly secures to a front pair and a rear pair of downrigger columns, each subassembly includes:

forward and rearward beams, each having a beam side and each being connected to each other by side box plates, a lower frame splice flange extends from each bean side, and each side box plate having an opening to receive stub pins positioned through apertures defined in the stub column assembly to secure the crane mount lower frame assembly thereto;

a plurality of pairs of downrigger columns, each pair of downrigger columns having upper ends configured to attach to opposing sides of the crane mount lower frame assembly such that lower ends, defined by each pair of downrigger columns, diametrically oppose each other; and a bearing pad secured to each lower end of the downrigger columns, and wherein the bearing pads are configured to frictionally engage opposing outside surfaces of the wall, whereby the loads from an articulating boom crane that is secured to the crane base transmits to the crane mount lower frame assembly that resists the loads by having compression forces applied to the wall by the bearing pads.

7. A single wall mount crane assembly configured to support an articulating boom crane against an existing upstanding wall, the wall having opposing outside surfaces, the assembly comprising:

a crane base configured to support an articulating boom crane, the crane base having front and rear lower ends;

a pair of stub column assemblies separately secured at the front and rear lower ends of the crane base;

a crane mount lower frame assembly secured below the pair of stub column assemblies;

a plurality of pairs of downrigger columns, each pair of downrigger columns having upper ends configured to attach to opposing sides of the crane mount lower frame assembly such that lower ends, defined by each pair of downrigger columns, diametrically oppose each other, and wherein each downrigger column, of the plurality of pairs of downrigger columns, includes:

a flange having first side configured to face the wall, a top cap and a bottom cap, the column further having an opening extending downward vertically through the top cap towards the bottom cap, a column splice flange secured to the first side towards the top cap and configured to attach to a portion of the crane mount lower frame assembly;

wherein the bearing pad is pivotally secured against the first side for frictional engagement against the outside surface of the wall;

a lever arm extending through the top cap towards the bottom cap, the lever arm having a pair of lower arm openings spaced to align separately with a pair of slots defined on the flange, and the lever arm further having an upper arm opening;

a pair of pivot pin received through the aligned openings in the pair of lower arm openings and the pair of slots and further aligned to pivotally secure the bearing pad thereto; and a tension rod attached between a pair of opposing lever arms through the upper arm openings defined in said opposing lever arms, wherein the tension rod is configured to apply a grip force at the bearing pad when the tension rod is tightened; and a bearing pad secured to each lower end of the downrigger columns, and wherein the bearing pads are configured to frictionally engage opposing outside surfaces of the wall, whereby the loads from an articulating boom crane that is secured to the crane base transmits to the crane mount lower frame assembly that resists the loads by having compressive forces applied to the wall by the bearing pads.

8. The assembly of claim 7, wherein the first side of the flange defined in each downrigger column further includes at least one lug opening to receive a pair of spaced shoe lugs extending from a bearing shoe, the bearing pad being secured to a side of the bearing shoe opposite the spaced shoe lugs, and the pair of spaced shoe lugs further have apertures to receive pivot pins.

9. The assembly of claim 7, wherein the pair of slots on the flange are defined as an upper slot orientated substantially horizontally and a lower slot orientated substantially vertically.

10. A single wall mount crane assembly configured to support an articulating boom crane against an existing upstanding wall, the wall having opposing outside surfaces, the assembly comprising:

a crane base configured to support an articulating boom crane, the crane base having front and rear lower ends;

a pair of stub column assemblies separately secured at the front and rear lower ends of the crane base, and wherein each stub column assembly includes and upper stub plate having opposing sides, and being secured to one of the front or rear lower ends of the crane base, column legs extending downwardly from the opposing sides of the upper stub plate, cheek plates extending from inside and outside edges of the column legs, each cheek plate having an aperture and wherein each stub column assembly further includes a stiffener tube positioned between the cheek plates that are positioned against the inside edges of the column legs, and stub pins positioned through the apertures of the cheek plates and openings defined in the crane mount lower frame assembly to secure the stub column assembly thereto;

a crane mount lower frame assembly secured below the pair of stub column assemblies, and wherein the crane mount lower frame assembly includes a pair of lower frame subassemblies;

a plurality of pairs of downrigger columns, each pair of downrigger columns having upper ends configured to attach to opposing sides of the lower frame subassembly such that lower ends, defined by each pair of downrigger columns, diametrically oppose each other; and a bearing pad secured to each lower end of the downrigger columns, and wherein the bearing pads are configured to frictionally engage opposing outside surfaces of the wall, whereby the loads from an articulating boom crane that is secured to the crane base transmits to the crane mount lower frame assembly that resists the loads by having compressive forces applied to the wall by the bearing pads.

11. The assembly of claim 10 further comprising a plurality of swivel mounts secured beneath the crane mount lower frame assembly, the plurality of swivel mounts are configured to engage a top surface of the wall to assist in leveling the assembly.

12. The assembly of claim 10, wherein each lower frame subassembly includes:

forward and rearward beams, each having a beam side and each being connected to each other by side box plates, a lower frame splice flange extends from each bean side, and each side box plate having an opening to receive the stub pins.

13. The assembly of claim 12, wherein each downrigger column includes:

a flange having first side configured to face the wall, a top cap and a bottom cap, the column further having an opening extending downward vertically through the top cap towards the bottom cap, a column splice flange secured to the first side towards the top cap and configured to attach to a portion of the crane mount lower frame assembly;

wherein the bearing pad is pivotally secured against the first side for frictional engagement against the outside surface of the wall;

a lever arm extending through the top cap towards the bottom cap, the lever arm having a pair of lower arm openings spaced to align separately with a pair of slots defined on the flange, and the lever arm further having an upper arm opening;

a pair of pivot pins received through the aligned openings in the pair of lever arm openings and the pair of slots and further aligned to pivotally secure the bearing pad thereto; and a tension rod attached between a pair of opposing lever arms through the upper arm openings defined in said opposing lever arms, wherein the tension rod is configured to apply a grip force at the bearing pad when the tension rod is tightened.

14. The assembly of claim 13, wherein the first side of the flange defined in each downrigger column further includes at least one lug opening to receive a pair of spaced shoe lugs extending from a bearing shoe, the bearing pad being secured to a side of the bearing shoe opposite the spaced shoe lugs, and the pair of spaced shoe lugs further have apertures to receive pivot pins.

15. The assembly of claim 13, wherein the pair of slots on the flange are defined as an upper slot orientated substantially horizontally and a lower slot orientated substantially vertically.

* * * * *